United States Patent [19]

Alexander

[11] Patent Number: 4,726,117

[45] Date of Patent: Feb. 23, 1988

[54] SHEARING HANDPIECE REAR SECTION

[75] Inventor: Lennox J. Alexander, Epping, Australia

[73] Assignee: Sunbeam Corporation Limited, Campsie, Australia

[21] Appl. No.: 877,328

[22] Filed: Jun. 23, 1986

[30] Foreign Application Priority Data

Jun. 24, 1985 [AU] Australia ..... PH1166

[51] Int. Cl.[4] ..... B26B 19/00

[52] U.S. Cl. ..... 30/220; 30/215

[58] Field of Search ..... 30/217-220, 30/276, 215; 16/110 R; 384/91, 126, 127

[56] References Cited

U.S. PATENT DOCUMENTS 2,651,107 9/1953 Bartlett ..... 30/219

2,974,413 3/1961 Williams ..... 30/219

*Primary Examiner*—Douglas D. Watts

*Attorney, Agent, or Firm*—Ladas & Parry

[57] ABSTRACT

A shearing handpiece rear section for connection between a drive tube assembly and a handpiece front section which includes a cutter and driving fork, and comprising an outer casing, a tubular bushing threaded therein and connected with a partly encircled tubular joint by a circlip to permit relative rotation and prevent axial displacement between the bushing and the joint, a drive shaft extending through the casing and journalled at opposite end portions in bearings supported in respective ones of the bushing and the joint, a crank head upon a forward end of the shaft and provided with clearance from a forward end of the bushing, and a drive cog upon a rearward end of the shaft and abutting the bearing in said joint, so that with axial thrust on the handpiece contact of said crank head with said bushing is avoided.

7 Claims, 1 Drawing Figure

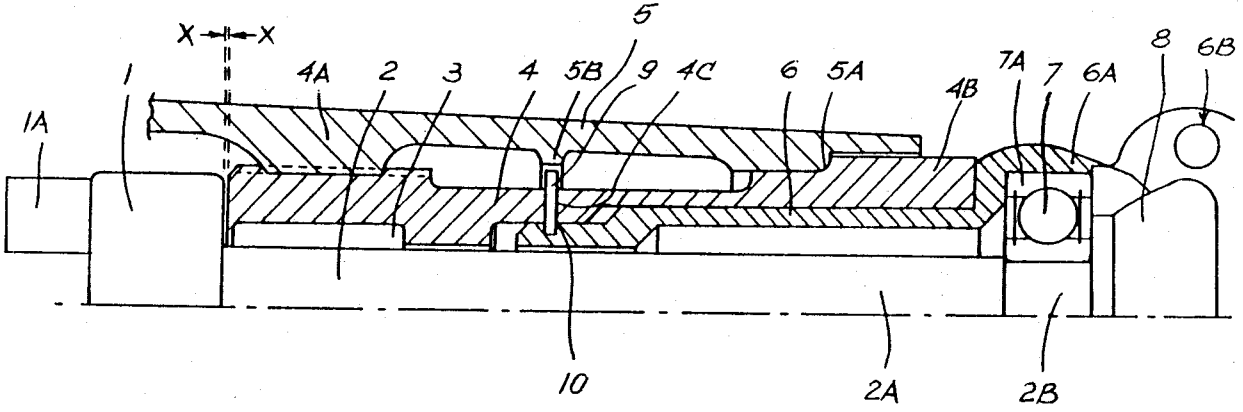
6B
8
6A
7
7A
4B
5A
6
4C
5
9
5B
4
3
2
4A
X
X
1
1A
2B
2A
10

SHEARING HANDPIECE REAR SECTION

BACKGROUND OF INVENTION

This invention pertains to shearing handpiece assemblies, and more particularly to the kind utilised in the wool shearing industry.

PRIOR ART

In the operation of these appliances a shearer will apply repeated strokes involving axial reciprocation of the handpiece, and a rolling action involving at least partial rotation of the handpiece. The appliance must be capable of facilitating such movement although it is connected through coacting driving cogs to an articulated drive tube assembly. This drive tube assembly inevitably transfers to the handpiece a series of inertial forces generated in response to the handpiece reciprocation.

It is common practice for a shearing handpiece to be constructed in two longitudinal separable parts, referred to as front and rear sections. An improved form of front section is disclosed in copending patent application Ser. No. 809,503 filed Dec. 16, 1985 and comprises a housing supporting a cutter assembly at a forward end and enclosing a driving fork receiving drive from a crank head at the forward end of the rear section of the handpiece.

According to the conventional construction of the rear section of shearing handpieces, the drive from the driving cogs is relayed through a spindle to a crank head with the spindle being journalled near the crank head within a bushing. The bushing also encloses part of a joint which forms the rear bearing for the spindle and which at the same time is free to rotate within the bushing.

A disadvantage of this construction is that both heat and wear develop between the crank head and the bushing at one end of the handpiece rear section and between the cog and the joint at the other end, due to friction therebetween resulting from the axial thrust imparted both to the joint and the cog.

SUMMARY OF INVENTION

It is a main object of the invention to provide a shearing handpiece rear section assembly which develops a relatively small amount of heat and wear as a result of thrust forces.

According to the invention there is provided a rear section of a shearing handpiece, comprising an outer casing having forward and rearward ends, a tubular bushing fixed within the casing, a tubular joint rotatable within the bushing, means for detachably securing the joint to the bushing against relative axial movement, a shaft journalled within the bushing near said forward end and journalled within the joint near its rearward end in a low friction bearing, a crank head upon the forward end of the shaft and spaced from the bushing, and a cog upon the rearward end of the shaft and abutting said bearing, whereby axial thrust on said handpiece is transferred by said low friction bearing to the joint without contact of said crank head with the bushing or contact of said cog with the joint.

BRIEF DESCRIPTION OF THE DRAWING

The invention will be described in more detail with reference to the accompanying drawing showing in half longitudinal section the rear section of a shearing handpiece constructed according to this invention.

BEST MODE OF CARRYING OUT INVENTION

The crank head 1 shown in the drawing carries a crank pin 1A for conventional engagement within the slotted driving fork of the front end of the handpiece. The crank head 1 is fixed upon the forward end of a spindle 2 rotatable within a needle bearing 3 internally carried upon a bushing 4 secured internally by thread 4A to an outer casing 5. In assembling the casing 5 is threadably advanced over the bushing 4 in the direction of from forward to rearward and until tightened down upon an annular shoulder 4C on the bushing and which is engaged by an internal annular shoulder 5A on the casing 5. A tubular joint 6 encloses the rearward end portion 2A of the spindle 2 and is rotatable within the rearward end portion 4B of the bushing 4.

The rearward end 2A of the spindle 2 has a journal 2B of reduced diameter to accommodate a low friction bearing 7, such as a ball race, which is held upon the spindle 2 by the cog 8. The outer cone 7A of the bearing 7 is preferably a press fit within the rearward end 6A of the joint 6. A thrust element 9, such as a circlip, secures the bushing 4 to the joint 6 against relative axial displacement. Preferably, the element 9 is a U-shaped circlip with its opposite arms engaged within diametrally opposed radial slots 4C in the bushing 4 and penetrating into an annular groove 10 in the inner end of the joint 6. Thus, it will be seen that the joint 6 is free to rotate with respect to the bushing 4 but is restrained against axial movement with respect thereto. When assembled, the circlip 9 is restrained from falling out of position not only by its usual detent at the base of the groove 10, but also by a confronting annular rib 5B in the casing 5, which has an internal diameter to just clear the outer diameter of the circlip 9.

As a result of the above construction, axially directed thrust forces which arise from inertial reaction imparted to a swivel pin 6B of the joint 6 by the mass of a drive tube assembly (not shown) are taken by interaction between the joint 6, the bushing 4, and the thrust element 9. The design can be such that movement to the left of the drawing by the joint 6 is restrained by the rearward part 4B of the bushing, while movement to the right of the drawing is restrained by the thrust element 9. Alternatively, both left and right hand restraints can occur at the thrust element 9. Cog reactions imparted to the cog 8 will be transmitted to either side of the bearing 7. The design is such that no axial displacement of the spindle 2 can occur, so that the clearance X is maintained at all times between the crank head 1 and the forward end of the bushing 4, while at no time does the cog 8 come into direct contact with the rearward end of the joint 6. Therefore, heat and wear which would otherwise occur in these areas due to thrust forces are maintained at a minumum. The rearward end 4B of the bushing 4 protrudes beyond the rearward end of the outer casing 5 so that assembly and disassembly of the components is a relatively simple matter. The entire assembly including the bushing 4 may be screwed rearwardly out of the casing 5 whereby through removal of either the cog 8 or the crank head 1 and then the thrust element 9 complete dismantling can be achieved.

Whereas a preferred embodiment has been described above other forms, modifications and refinements are contemplated within the scope of this invention.

What I claim is:

1. A rear section of a shearing handpiece, comprising an outer casing having forward and rearward ends, a tubular bushing fixed within the casing, a tubular joint at least partly enclosed by said bushing; a detachable thrust resistant element securing said joint and said bushing together relatively rotatably and preventing relative axial movement between said joint and said bushing, a first bearing fixed internally of and near a forward end of said bushing, a second bearing fixed internally of and near a rearward end of said joint, a shaft journalled within said first and second bearings and having an abutment engaging one of said bearings and preventing axial displacement in one direction between said shaft and said bearings, a crank head upon a forward end of said shaft and spaced from said bushing, and a cog upon the rearward end of said shaft and abutting said second bearing to prevent axial displacement in another direction between said shaft and said bearings, whereby despite axial thrust on said handpiece said spacing between said crank head and said bushing is maintained.

2. A rear section of a shearing handpiece according to claim 1, wherein the casing is threadably engaged with the bushing for ready disassembly and is screwed down onto an abutment upon the bushing for assembly.

3. A rear section of a shearing handpiece according to claim 1, wherein said thrust resistant element is a circlip.

4. A rear section of a shearing handpiece according to claim 3, further comprising an annular rib within the casing confronting the circlip and having an internal diameter to clear the outer diameter of said circlip to restrain the latter from disengagement.

5. A rear section of a shearing handpiece according to claim 1, wherein when assembled the rearward end of the bushing protrudes beyond the rearward end of the casing.

6. A rear section of a shearing handpiece according to claim 1, wherein said first bearing is a needle bearing and said second bearing is a ball race.

7. A rear section of a shearing handpiece according to claim 1, wherein said abutment on said shaft engages said second bearing and is obtained by providing an end of reduced diameter on said shaft.

* * * * *